United States Patent [19]

Jacob

[11] Patent Number: 4,720,890

[45] Date of Patent: Jan. 26, 1988

[54] VACUUM CLEANER HANDLE

[75] Inventor: Gernot Jacob, Weissach, Fed. Rep. of Germany

[73] Assignee: Progress-Elektrogeraete Mauz & Pfeiffer GmbH & Co., Fed. Rep. of Germany

[21] Appl. No.: 857,920

[22] PCT Filed: Aug. 16, 1985

[86] PCT No.: PCT/EP85/00420

§ 371 Date: Apr. 2, 1986

§ 102(e) Date: Apr. 2, 1986

[87] PCT Pub. No.: WO86/01089

PCT Pub. Date: Feb. 27, 1986

[30] Foreign Application Priority Data

Aug. 17, 1984 [DE] Fed. Rep. of Germany ..... 3430402

[51] Int. Cl.[4] ..... A47L 9/00; A47L 9/32

[52] U.S. Cl. ..... 15/323; 15/410

[58] Field of Search ..... 15/323, 410, 377

[56] References Cited

U.S. PATENT DOCUMENTS

| | | | |
|---|---|---|---|
| 3,667,084 | 6/1972 | Valbona et al. | 15/410 X |
| 3,705,437 | 12/1972 | Rukavina et al. | 15/322 X |
| 4,541,142 | 9/1985 | Pudwill | 15/323 |
| 4,615,068 | 10/1986 | Martin et al. | 15/323 |

FOREIGN PATENT DOCUMENTS

| | | | |
|---|---|---|---|
| 725344 | 1/1966 | Canada | 15/410 |
| 3140131 | 4/1983 | Fed. Rep. of Germany | 15/410 |
| 5090 | 8/1919 | Netherlands . | |
| 6512312 | 5/1966 | Netherlands | 15/329 |
| 8202745 | 2/1983 | Netherlands | 15/323 |

*Primary Examiner*—Chris K. Moore

*Attorney, Agent, or Firm*—Birch, Stewart, Kolasch & Birch

[57] ABSTRACT

A vacuum cleaner handle comprising a connection member connected to a handle tube and a handle member by which the vacuum cleaner handle is held during use and may be moved along with only little effort. In the working position of the vacuum cleaner, this handle member includes a handle portion positioned at least partly disposed over the axis of a central handle tube and at an acute angle thereto. A cord drum is attached to the vacuum cleaner handle. A cord of the vacuum cleaner may be wound up in the cord drum simply and neatly without the cord drum placed under the vacuum cleaner handle interfering with the use of the vacuum cleaner.

24 Claims, 11 Drawing Figures

VACUUM CLEANER HANDLE

BACKGROUND OF THE INVENTION

The present invention relates to a vacuum cleaner handle.

Vacuum cleaners conventionally have a handle with a plug connection part inserted into a tubular handle extending to the rear over the vacuum cleaner housing. The plug part is locked in a catch opening in the handle tube by means of a catch button to prevent twisting. The handle part has a slight downward slant in relation to the axis of the plug part in the working position of the hand-driven vacuum cleaner.

Since such a vacuum cleaner is moved along and steered with the handle part it is quite likely for the handle part to twist in the hand, in relation to the sliding nozzle or the suction brush, with the result that it is no longer possible to efficiently steer the vacuum cleaner and it may run up against furniture, door frames or the like. Such a loss of control is more especially likely when using nozzles whose joint enables them to be turned and tilted. Owing to the downward slant there is a very inconvenient levering effect so that the user is compelled to exert powerful lateral forces in order to hold the hand vacuum cleaner in a position in which it is swiveled or rocked to the side.

SUMMARY OF THE INVENTION

An object of the invention is to so improve upon a vacuum cleaner cleaner handle of the type initially specified that the vacuum cleaner may be conveniently and simply held and moved, this being possible with a small amount of effort even in the swiveled or laterally tilted position.

Furthermore the handle should rest comfortably in the hand of the user.

This object is achieved in the case of a vacuum cleaner of the initially specified type in accordance with the features of the present invention.

The handle member includes a holding part positioned at least partly over a central axis of the handle tube providing a lever arm which may be rocked to the right or the left, with only a small amount of effort, around the axis of the connection part. Accordingly, only a small amount of lateral force is needed for control so that the vacuum cleaner may be steered from the one side to the other. This favorable leverage reduces the force necessary to move and direct the vacuum cleaner. The simple and low-effort manner of moving the vacuum cleaner makes it possible to steer it around furniture and along walls or the like without knocking against them so that they are not damaged.

The design in accordance with the invention furthermore offers the advantage that the vacuum cleaner may be moved along by the user in a comfortable pose at a very small angle to the surface to be cleaned so that for example vacuum cleaning under furniture is greatly facilitated.

It is an advantage of the handle part is placed entirely over the axis. This design leads to the advantage of a particularly convenient lever arm, which makes it particularly simple for the user to move the vacuum cleaner along the floor.

In accordance with a further advantageous feature of the invention, a portion of the handle part makes an acute angle with the axis of the handle tube and of the connection part and an upper portion of the handle part projects out ahead in the direction of the connection part. This makes it possible for the user to move the vacuum cleaner in a generally comfortable pose even at a very small acute angle to the surface to be cleaned. This acute angle may amount to approximately 60°.

In accordance with a further proposal of the invention, the handle part is located partly over and partly under the central axis of the handle tube and the connection part. This development of the invention also makes it possible for the vacuum cleaner to be particularly comfortably held and moved and swiveled about the tube axis with little effort, since the user is able to grasp the handle part near the axis of the handle tube.

In this respect it is particularly advantageous if the handle part is located approximately half way over and half way under the handle tube central axis. This construction offers the advantage that the vacuum cleaner handle according to the invention may also be used particularly conveniently in a position swiveled through 180° about the handle tube of the vacuum cleaner so that cleaning under furniture may in suitable cases be substantially facilitated.

In accordance with a further feature of the invention, the handle part forms the back member of a polygonal holding part, which adjoins the connection tube. This handle holding part may with advantage furthermore possess an upper bar, which adjoins the handle at its upper part and is generally parallel to the axis of the tube, a front bar extending forwards at an obtuse angle of approximately 120° to the tube axis, a first lower bar running back generally parallel to the axis of the tube, a bar running downwards generally parallel to the handle part and a rear lower bar arranged generally parallel to the axis of the tube, which is adjacent to the lower end of the handle part. Given this special form of the holding part having the handle part, the overall vacuum cleaner handle will very comfortably fit into the hand, it being possible for the vacuum cleaner also to be maneuvered using the top bar as well that runs generally parallel to the tube axis, if it is to be used in a raised position, for example.

The invention furthermore provides a device for accommodating accessories of the vacuum cleaner, more especially a crevice nozzle, which comprises a trough-like, downwardly opening receptacle for accommodating the crevice nozzle, which is mounted under the handle holding part, the lower edge of the receptacle being generally flush with the lower edge of the rear lower bar. This design offers the advantage that owing to the elongated and relatively shallow trough-like receptacle (which is due to the form of the crevice nozzle) the handle is not markedly increased in size and is therefore not rendered awkward to use. The handling of the vacuum cleaner is in no way interfered with by the arrangement of the crevice nozzle under the handle.

The trough-like receptacle comprises a component for holding and releasing the inserted crevice nozzle, such component being able to be slid in grooves formed at the lateral edges of the receptacle between a retaining and a release position. The release position is in this case located at the end section of the trough-like receptacle, which is associated with the flat end of the crevice nozzle, the holding component being displaced for holding the inserted crevice nozzle towards the center part of the receptacle until the crevice nozzle is clamped firmly in the receptacle. This accordingly prevents any irritating rattling noise of the crevice nozzle in the receptacle.

It is convenient if the holding part, the trough-like receptacle and the connection tube are made integrally so that the costs of production of the handle in accordance with the invention may be kept low.

In accordance with a particularly advantageous feature of the invention a cord drum for the electrical cord is arranged on the vacuum cleaner handle. This means that there is a favorable position of the center of gravity of the hand vacuum cleaner so that it may be very simply and comfortably maneuvered without any great effort being required. Furthermore owing to the presence of the cord drum the electrical cord may be simply rolled up neatly any time without any chance of the cord coming out of the drum by accident.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF PREFERRED EMBODIMENTS

Figures 1, 1A:
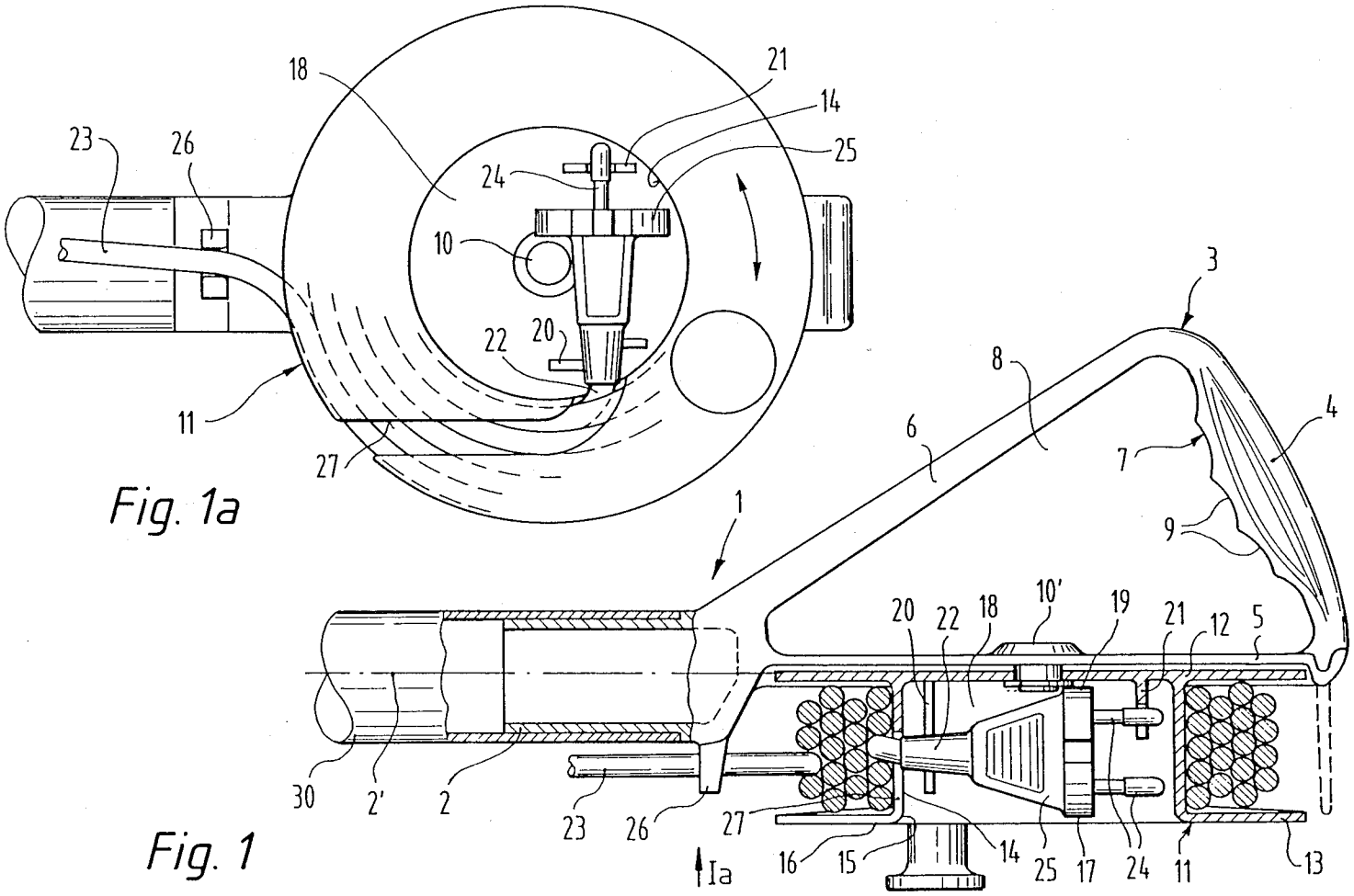
FIG. 1 shows a first working example of a vacuum cleaner handle from the side.
FIG. 1*a* is a view looking in the direction of the arrow Ia in FIG. 1.

The handle member 1 of FIG. 1 is inserted into a handle tube 30 of a hand-maneuvered vacuum cleaner and it has a tubular connection part 2 serving as a plug part, and a holding part 3, preferably made integrally with the same, and whose circular disk 5 and a connection member 6 adjoin the plug part 2. The circular disk 5 and the connection member 6 are connected together on the side remote from the plug part 2 by way of a handle bar member 4 forming part of the handle member. In side view as in FIG. 1 the holding part 3 has the form of a generally right-angle triangle, whose hypotenuse is formed by the circular disk 5 and whose adjacent sides are formed by the handle bar member 4 and the connection member 6. The handle bar member 4, the connection member 6 and the circular disk 5 are preferably made integrally with each other. The circular disk 5 is preferably generally at the same level as the axis 2' of the plug part 2. The connection member 6 directly adjoins the plug part 2. In order to be able to hold the handle bar member 4 firmly, it is made thicker than the circular disk 5 and the connection member 6. It has a convex inner side 7 which forms the one side of a handle opening 8 as defined by the handle bar member 4, the circular disk 5 and the connection member 6. The inner side 7 furthermore has finger grooves 9 running perpendicular to the longitudinal direction of the handle bar member 4 for the hand of the user gripping the handle bar member 4. The handle bar member 4 makes an angle of about 60° with the circular disk 5. The connection member 6 and the handle bar member 4 are in a common plane which runs normal to the circular disk 5. Owing to this configuration, the circular disk 5 does not interfere with operation of the vacuum cleaner because it is then clear of the part gripped with the hand.

A bearing pin 10 (FIG. 1*a*) for a cord drum 11 is attached to the circular disk 5. The point of attachment of the bearing pin is marked in FIG. 1 as a thickened part 10' of the circular disk 5, and in it one end of the bearing pin is secured and it extends into the handle opening 8.

The cord drum 11 has a circular disk 12 and an annular disk 13, which are placed opposite each other with a spacing inbetween and are joined together by a cylinder 14 formed integrally with them. The cylinder is perpendicular to the circular disk 12 and its end remote from the circular disks 5 and 12 is set at an angle in an outward direction in the manner of a flange forming the annular disk 13 at a right angle.

The cylinder 14 delimits a receptacle 18, which is open in an outward direction and is shut off by a part of the circular disk 12 towards the handle 1.

In the receptacle 18 there are prongs 20 and 21 projecting normally from the circular disk 12. An end section 22 of an electrical cord 23 is located at the prong 20. The one plug pin 24 of an electrical plug 25 is placed between the two mutually parallel prongs 21. In this manner the plug 25 is held in place when the cord 23 is being wound up on the cord drum 11. To ensure that the cord is wound up in neat, adjacent turns on the drum, there is a holding part 26 on the plug part 2. It is in the form of a single or double hook to hold the cord 23 in it. The holding part 26 is provided on the plug part 2 directly in front of the cord drum 11 so that the cord 23 is guided in the direction of winding up where it runs in and it is therefore able to be wound up on the drum without the least trouble and without having to be lifted from the floor for this purpose.

The disk 5, which may have a different outline or may for instance be replaced by a strut, is in a position corresponding to half the height of the plug part 2. The cord drum 11, which has its circular disk 12 directly adjacent to the circular disk 5, accordingly only projects a small amount past the handle tube 30 so that the cord drum does not interfere with the way in which the handle 1 is held and in which cleaning is carried out.

To wind up the cord 23 the plug 25 is firstly placed in the receptacle 18, the end section 22 of the cord is placed against the prong 20 and the plug pin 24 is inserted in position between the prongs 21. Lastly, the end section 22 adjoining the plug 25 is inserted into an axial slot 27 in the cylinder and in the annular disk 13. The slot 27 extends right through the annular disk 13 and approximately for half the length of the cylinder 14.

On the handle or the holding part 3 it is possible to have a casing spaced from the cord drum 11 and at least partly surrounding it (see the broken line in FIG. 1). The casing at least partly encloses the cord space in the drum.

Figure 2:
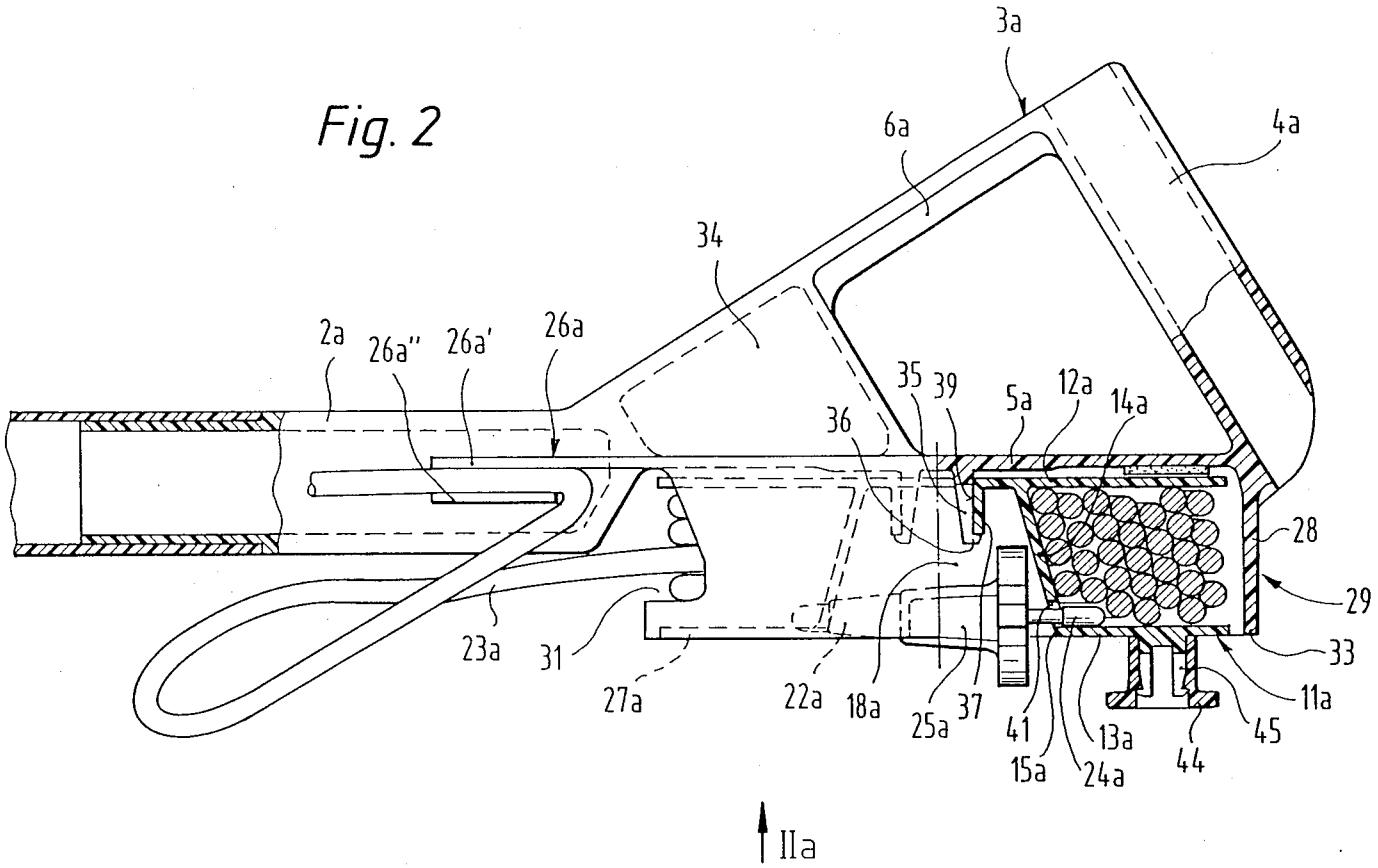
FIG. 2 shows a second working embodiment of a vacuum cleaner handle in accordance with the invention partly in elevation and partly in axial section.
Figure 2A:
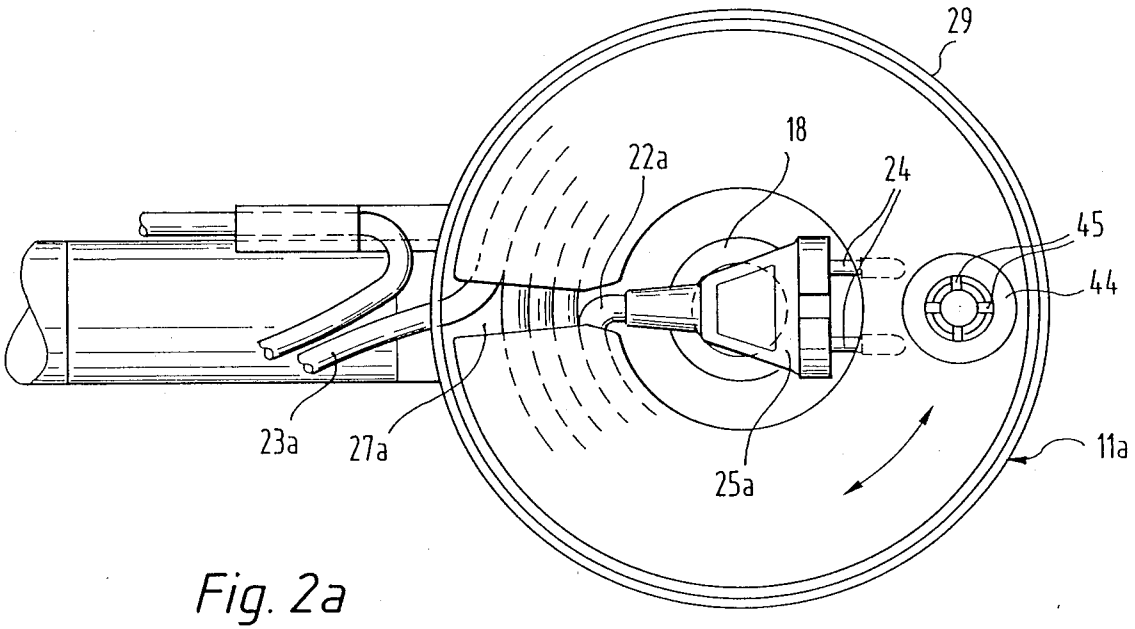
FIG. 2*a* is a view looking in the direction of the arrow IIa in FIG. 2.

The embodiment in accordance with FIGS. 2 and 2*a* has a cylindrical enveloping skirt 28 extending past the circular disk 5*a*, and with the circular disk it forms a trough-like receptacle 29 for the cord drum 11*a*. The skirt 28 has an entry slot 31 for the cord 23*a*, which extends over a part of the height of the skirt and is made broader at a small distance from the end 33 of the skirt. On the end a guide edge 34 is formed in this manner, which functions as a guide for the cord 23*a* when same is being wound up and therefore ensures an efficient guiding action and neat winding.

The circular disk 5*a* has resilient prongs 35 extending from it perpendicularly and annularly, the free end 36 thereof being bent at a right angle in an outward direction. The resilient prongs 35 function as axial positively engaging members for the cord drum 11*a*. The same has a central annular member 37, that projects normally from an inner annular disk 12*a*. For assembly, the annular member 37 of the cord drum 11*a* is mounted on the resilient prongs 35 and is then pressed inwards towards the circular disk 5*a*, the resilient prongs 35 then being pressed elastically inwards until their angled ends 36 snap into place around the annular member 37. The diameter of a central annular opening 39 in the annular disk 12*a* is smaller than the diameter of the outer annular disk 13*a*. The annular disks 12*a* and 13*a* are joined together by a hub 14*a* which widens conically in an outward direction and the hub, like the cylinder 14 in FIG. 1, adjoins the outer annular disk 13*a* at the edge of an opening 15*a* therein. The hub 14*a* defines a well 18*a* for the plug 25*a* whose pins 24*a* extend into openings 41 of the hub 14*a*.

The end section 22*a* of the cord 23*a* may be slipped into the position shown in FIG. 2 through the slot 27*a*, shown in FIG. 2*a*, in the annular disk 13*a* and the hub 14*a*, which is fashioned in the same way as the slot 27 in FIG. 1. After the vacuum cleaner has been used, the plug 25*a* may be placed in the well 18*a* in the cord drum 11 and its pins 24*a* plugged into the openings 41 in the hub 14*a* so that the plug is securely attached in the cord drum. It is then possible for the end section 22*a* of the cord 30*a* to be pushed into the slot 27*a* in the annular disk 13*a* and into the hub 14*a*. Following this it is only necessary for the cord drum 11*a* to be turned using its handle 44 in order to wind up the cord 23*a*. The handle 44 is snapped onto resilient prongs 45, which project perpendicularly from the annular disk 13*a* and are made integrally with same.

In order to hold the cord 23*a* there is a clamping device 26*a* on the plug part 2*a*, and it is made up of two clamping members 26*a*' and 26*a*'' between which the cord is placed. The clamping member 26*a*' is formed by an extension of the circular disk 5*a*. In this embodiment of the invention the handle bar 4*a* is tubular. The connection member 6*a* is decidedly longer than in the embodiment in accordance with FIGS. 1 and 1*a* and it connects the handle bar member 4*a* with a shell-like connection member 34, which is provided in the end part between the plug part 2*a* and the circular disk 5*a*.

Figure 3:
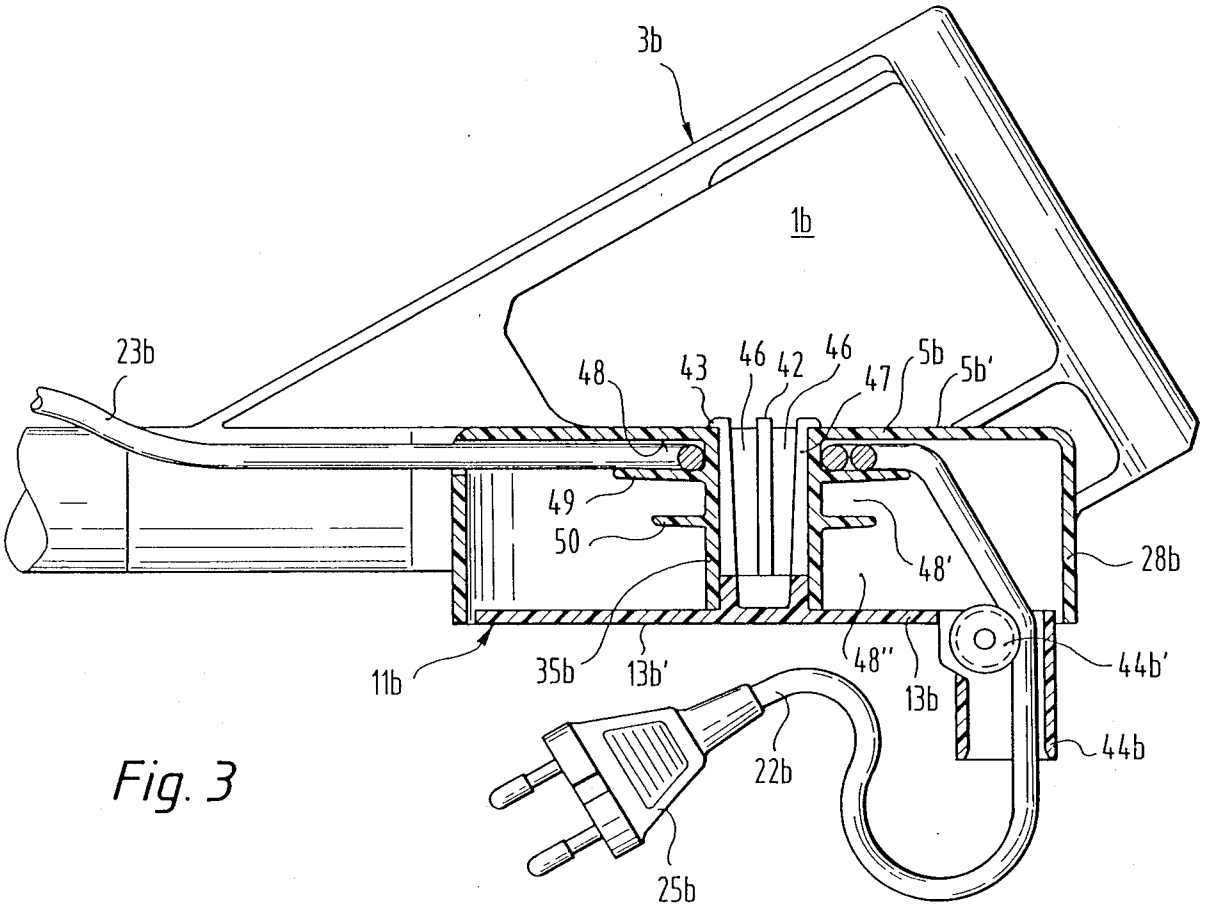
FIGS. 3 to 6 each show further embodiments of a vacuum cleaner handle in accordance with the invention in a side view and partly in section.

In the embodiment of FIG. 3 the circular disk 13*B* has a central sleeve-like plug part 42, whose free end is provided with a plurality of axially extending slots 46 between which there are resiliently elastic fingers 47, whose free ends are angled at 43. In the assembled condition the plug part 42 extends into a bushing 35*b*, which projects from the circular disk 5*b* and is made integrally with it. The plug part 42 is made so long that its angled parts 43 rest on the outer side 5*b*', remote from the bushing 35*b*, of the circular disk 5*b*. The plug part 42 makes it possible for the circular disk 13*b* to be simply put on and held in place by a detent effect.

The bushing 35*a* extends generally as far as the circular disk 13*b* so that the plug part 42 is efficiently held. Two spaced annular disks 49 and 50 are provided on the bushing 35*b* and they are perpendicular to the axis of the head. The annular disk 50 nearer to the circular disk 13*b* has a smaller diameter than the other annular disk 49.

Between the annular disk 49 and the circular disk 5*b*, between the two annular disks and between the annular disk 50 and the circular disk 13*b* there is a respective winding up space 48, 48' and 48'' for the cord 23*b*. Just as is the case with the embodiment of FIGS. 1 and 1*a*, the handle 1*b* is provided with the skirt 28*b*, which least partly envelopes the cord drum 11*b*, and extends as far as the level of the outer side 13*b*' of the circular disk 13*b*. Accordingly the circular disk 13*b* is within the space enclosed by the skirt 28*b*.

The cord 23*b* firstly runs along the handle tube from the vacuum cleaner (not shown) which is connected with the lower end of the handle tube. Just short of the handle 1*b* it runs through an opening (not shown in detail) into the handle and then through an opening (not shown) in the skirt 28*d* to the bushing 35*b*. Here the cord 23*b* is best detachably anchored in the winding space so that it may be efficiently wound up again after it it has been completely drawn off from the cord drum. The cord 23*b* is led out again through a handle 44*b* on the cord drum 11*b*, this handle being placed near the edge of the circular disk 13*b* and being hollow. When the cord 23*b* is completely wound up the plug 25*b* is on the handle 44*b*.

For withdrawing the cord 23*b* the cord drum 11*b* is turned with one hand on the handle 44*b* and with the other hand the cord is pulled out. There is an idler roller 44*b*' mounted in the handle 44*b* adjacent to the circular disk 13*b*. This roller projects a slight amount past the circular disk 13*b* towards the handle 1*b* and it functions as a guide and bend point for the cord 23*b*, which is accordingly diverted towards the bushing 35*b*.

If the cord 23*b* is to be wound up after being completely drawn off, it is firstly wound up in the winding space 48. To do this, the cord 23*b* is detachably secured in the wind up space 48 so that it comes into the wind up space as a matter of course. The user only has to turn the cord drum 11*b* using the handle 44*b*; the cord 23*b* is then automatically wound up. Once the diameter of the coil of cord is larger than the diameter of the annular disk 48, the cord moves into the wind up space 48' and is wound up there. Ultimately the cord 23*b*, if it is long enough for this, passes into the wind up space 48''. Accordingly the cord 23*b* may be neatly wound up without any trouble.

Figure 4:
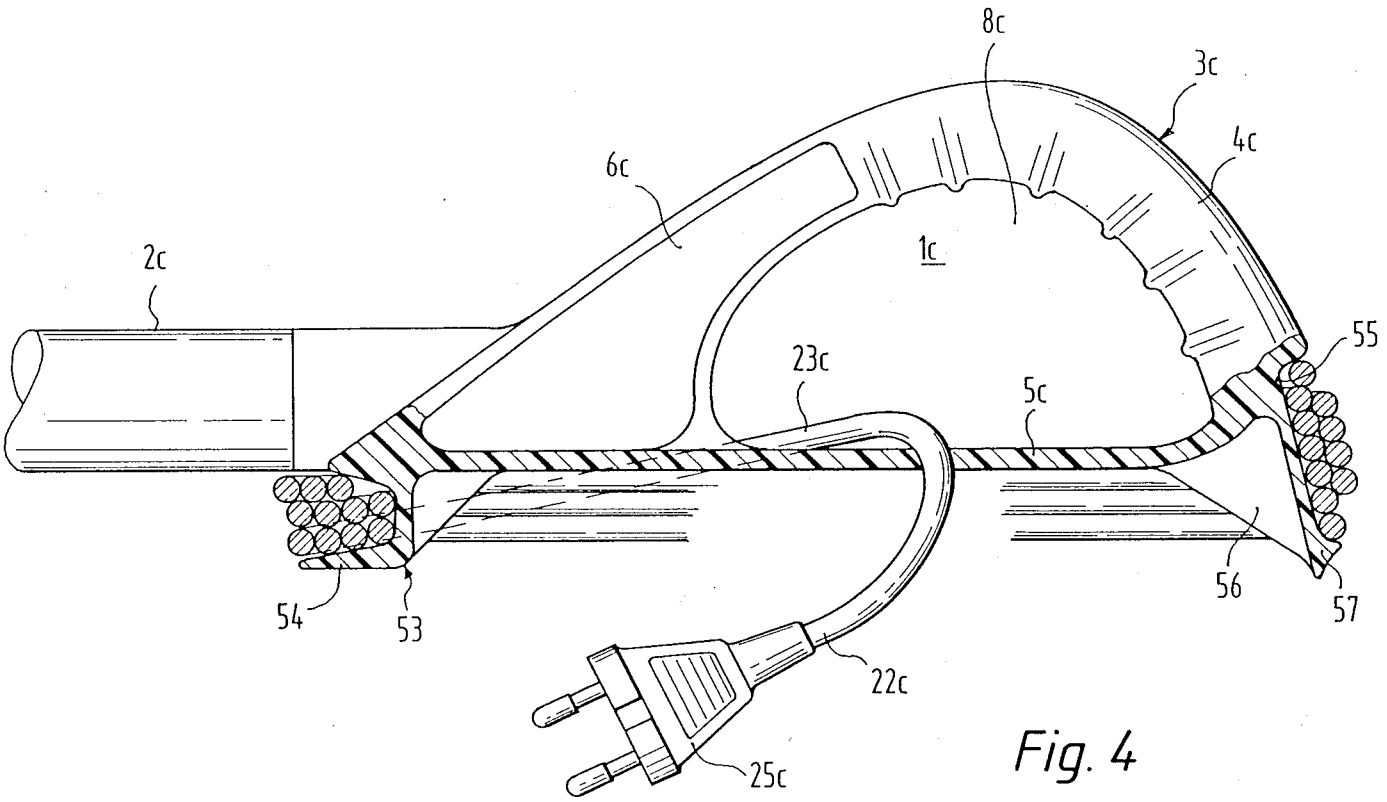

In the working example shown in FIG. 4 there is no rotary cord drum. The handle 1*c* is provided with two notches 53 and 55 into which the cord 23*c* is placed when it is wound up. The notches 53 and 55 are at the two ends of the holding part 3*c*. The notch 53 is formed in the wall 5*c* adjacent to the holding part 3*c* and projects beyond it. The notch 54 is delimited by a part 54, having an L-like cross section, and the adjacent end of the connection member 1*c*, and is adjacent to the plug part 2*c*. The notch 55 is formed by a recess on the handle bar member 4*c* perpendicular to the wall part 5*c*. The handle section 57 is reinforced by a triangular web 56, which runs between the wall part 5*c* and the handle section 57. The free end 22*c* of the cord with the plug 25*c* is trained through the handle opening 8*c* in the non-use position and is placed around the wall part 5*c* so that the cord 23*c* may not be accidentally wound up. The side adjacent the handle opening 8*c* of the handle bar member 4*c* is suitably shaped so that it may be readily grasped. The handle bar member 4*c* merges in a curved part with the connection member 6*c* which steadily widens towards the wall part 5*c*.

Figure 5:
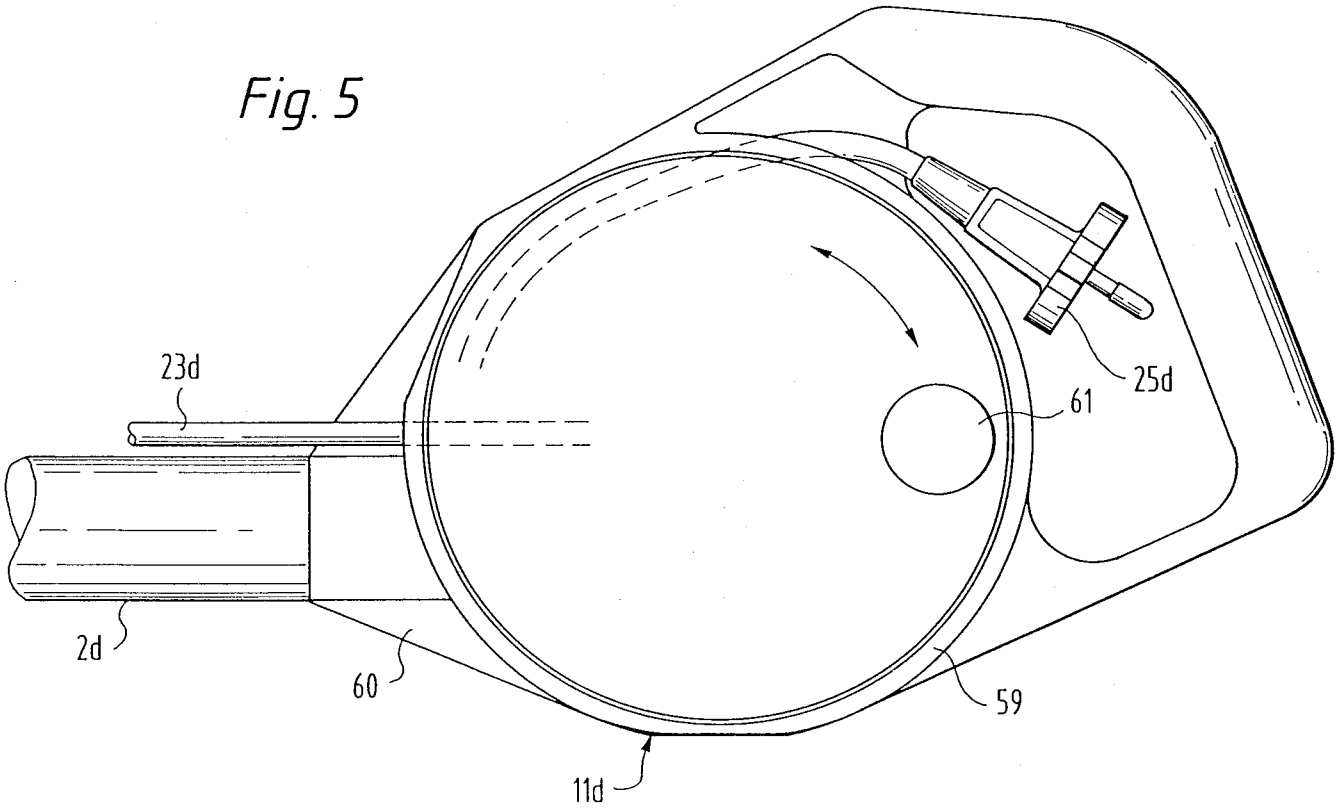

In the working example of FIG. 5 there is a cord drum 11*d* which may be detached from the handle 1*d*. The cord drum is here a conventional cord drum with a housing surrounding it on all sides and in which the cord is wound up so that it may not be seen from the outside. The housing 59 has an inlet and an outlet opening for the cord 23*d*. The cord drum 11*d* is supported on an attachment part 60 formed integrally with the handle 1*d* and which extends between the handle and the plug part 2*d*.

The cord drum is only attached to the handle 1*d* in the non-use condition. When the vacuum cleaner is used the cord drum 11*d* is taken off the handle and the plug 25*d* of the cord 23*d* is plugged into a wall socket. The cord 23*d* is permanently attached to the vacuum cleaner. If the cord drum 11*d* is taken off the handle 1*d* the cord will be pulled out of the drum. Since the cord drum 11*d* of the vacuum cleaner is no longer secured on the handle 1*d* the vacuum cleaner will be lighter when moved about by an amount equal to the weight of the cord drum so that it may be simply and easily moved to and fro on the floor which is to be cleaned with little effort. Furthermore, the appearance of the vacuum cleaner is not impaired by the cord drum while it is being used.

A further advantage is that when the cord 23*d* is wound up it will not run up against parts of the vacuum cleaner and so damage them. The cord drum 11*d* has a handle 61 which is connected with a drum disk or the like which is turned to wind up the cord 23*d*. It is also possible to have a return spring in the cord drum 11*d* so that the cord 23*d* will be automatically wound up. It is convenient if the return spring is able to be locked so that when pulled out the cord 23*d* will not be acted upon by the returning force of the spring.

Figure 6:
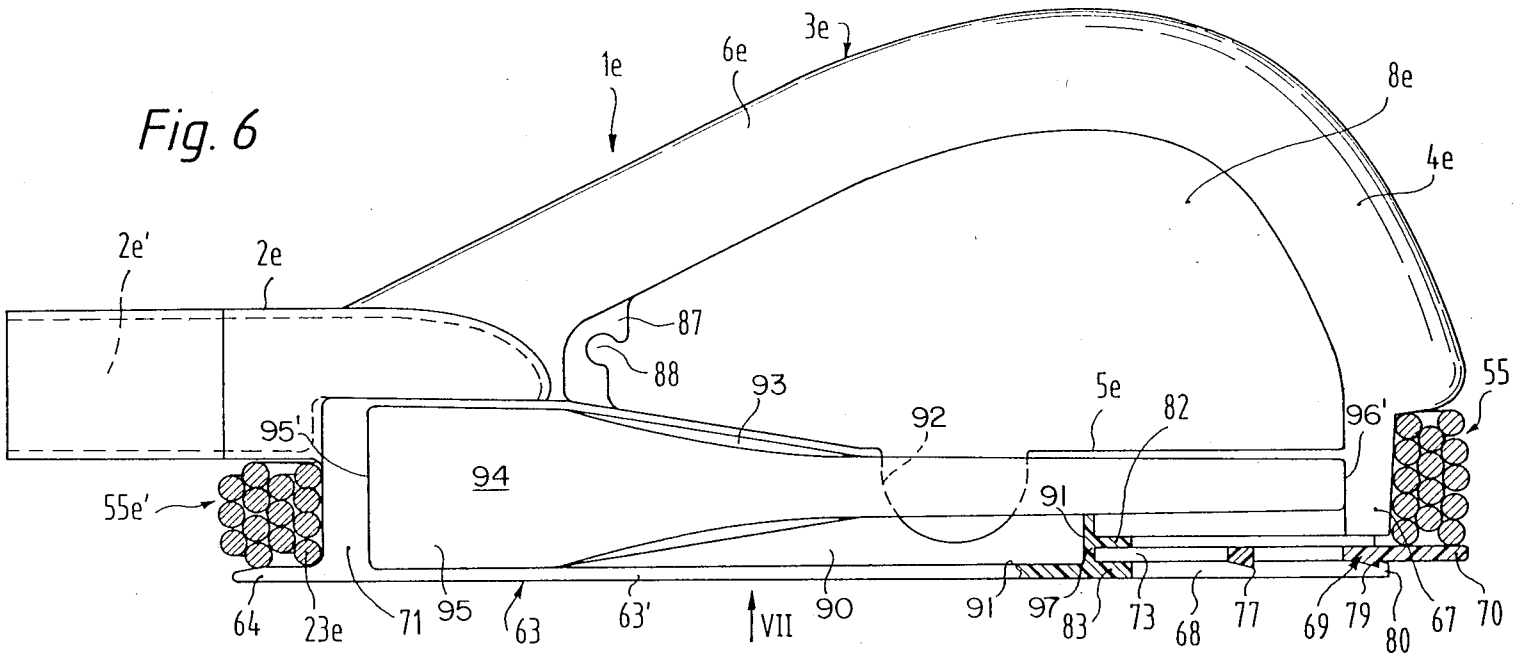
Figure 7:
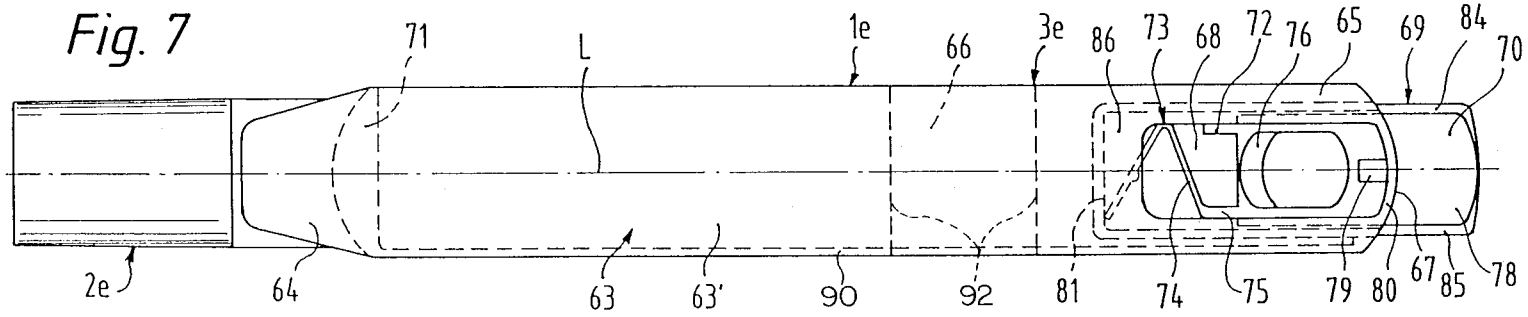
FIG. 7 shows the handle in accordance with FIG. 6 looking in the direction of arrow VII of FIG. 6.

In the working example of FIGS. 6 and 7 the cord 23*e* is wound onto a handle section 63 which projects past the holding part 3*e* with the handle bar member 4*e* and the correction part 2*e* of the handle member 1*e* with which it is made integrally. The handle section 63 has a rectangular plate part 63', remote from the holding part 3*e*, which is connected with the wall 5*e* by struts 67 and 71. The strut 67 is formed by the end of reduced cross section of the handle bar member 4*e*. The strut 71 adjoins the plug correction part 2*e* generally at a right angle. The two struts 67 and 71 extend along the full breadth of the plate part 63'. A flange part 64 adjoins the strut 71 at a right angle, such flange part 64 forming a continuation of the plate part 63' (FIG. 6), and it has an outline in the form of a trapezoid (FIG. 7). With the plug connection part 2*e* and the flange part 64 or with the handle bar member 4*e* and a securing flange part 69 the struts 67 and 71, respectively, wall off an outwardly opening wind up recess 55 and 55*e'* for the cord 23*e*.

The securing flange part 69 is accommodated in a linear guide 68 so that its one end 70 projects therefrom. The end 72, which is to the front of the direction of insertion, of the securing flange part 69, is U-shaped in form (FIG. 7) and is made integrally with a spring part 73, which engages an end 81 of the linear guide 68. The spring part 73 is V-shaped and its one member 74 adjoins a member 75, of the end 72 of the securing flange part 69, running parallel to the longitudinal center plane L of the handle 1*e*.

A transverse bar 76 of the end 72 of the securing flange part 69 has a trapezoid cross section (FIG. 6) and its one edge 77 extends past the securing part 69. At some distance from the transverse bar 76, the securing flange part 69 is provided with a projection 79 having a triangular cross section. The transverse bar 76 and the projection 79 form detent hooks, which, urged by the force of the spring part 73, abut a transverse bar 80 of the plate part 63'. With the two detent hooks 76 and 79 it is possible for the securing part 69 to be placed in two different positions so that the handle may be employed for different lengths of cord.

The linear guide 68 is formed by two mutually parallel plates 82 and 83 (FIG. 6) which are U-shaped and fit around the longitudinal edges 84 and 85 of the securing flange part 69. The transverse bar 80 delimits a substantially rectangular opening 68 is the plate part 63, while a further transverse section 86, that is of plates 82 and 83, delimits the opening on the side of the flange 64. In the locked position (FIG. 6), the securing flange part 69 is spaced clear of the strut 67 so that it may be bent elastically with respect to the bar 80 for unlocking and changing the position of the securing part.

At the transition between the connection member 6*e*, which merges with the handle bar member 4*e* in a curved fashion, and the wall 5*e* there is a clamping holding means 87 in the handle opening 8*e* and in the clamping opening 88 of the means 87 it is possible for the cord 23*e* to be gripped when it has been unwound from the cord drum.

In the part of the handle between the struts 67 and 71 the handle section 63 has a generally constant channel cross section and on its one side parallel to the longitudinal plane L of the handle it is open.

The struts 67 and 71 of the plate part 63' and the wall 5*e* are joined together by a back wall plate 90 (FIG. 7) which is also substantially rectangular and which is opposite the opening 91 of the handle section 63. The back wall plate 90 forms, the plate part 63' and the wall 5*e* form the handle section 63.

In the back wall plate 90 there is a recess 92, opening at its edge into the handle opening 8*e*. The recess is approximately semicircular and the handle section 63 is of such a size that the receptacle 93 formed therein may contain a crevice nozzle 94 lowered into it and be accommodated with a more or less positive locking effect. This crevice nozzle 94 is so arranged that the edge 95' of its plug connection part 95 (to be plugged onto the vacuum cleaner) and the edge 96' of its narrower nozzle part rest on the facing inner sides of the struts 67 and 71. The crevice nozzle 94 furthermore has its plug connection part 95 adjoining the inner sides of the plate part 63' and the wall 5*e* and its nozzle part 96 adjoins the wall 5*e*, whereas it is supported on the opposite side by a web 97 projecting perpendicularly past the plate part 63' and the linear guide 68 in the direction of insertion of the securing flange part 69 of the web 97 limited on the back side. The configuration and arrangement of the handle section 66 has the advantage that it is here possible to simply accommodate the crevice nozzle 94 or another similar accessory nozzle or brush of the vacuum cleaner by simply pushing it past the receiving opening 91 into the receptacle space 93. Consequently the crevice nozzle 94 is at hand at all times during use. If it is needed, it only has to be pushed out of the handle section 66 by the user putting his index finger into the recess 92 in the back wall plate 90 and then pressing on the nozzle part 96. This causes the crevice nozzle 94 to be pushed out of the receptacle space 93 and it may then be simply pushed onto the end, adjacent to the floor, of the vacuum tube of the vacuum cleaner.

Figure 8:
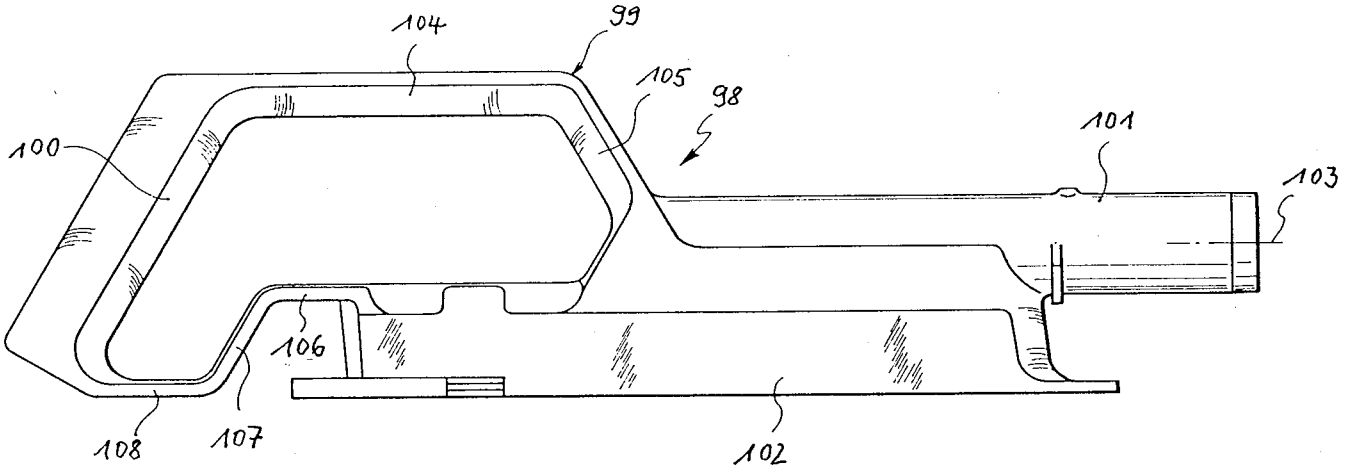
FIG. 8 is a side view of a further working example of the vacuum cleaner handle in accordance with the invention.
Figure 9:
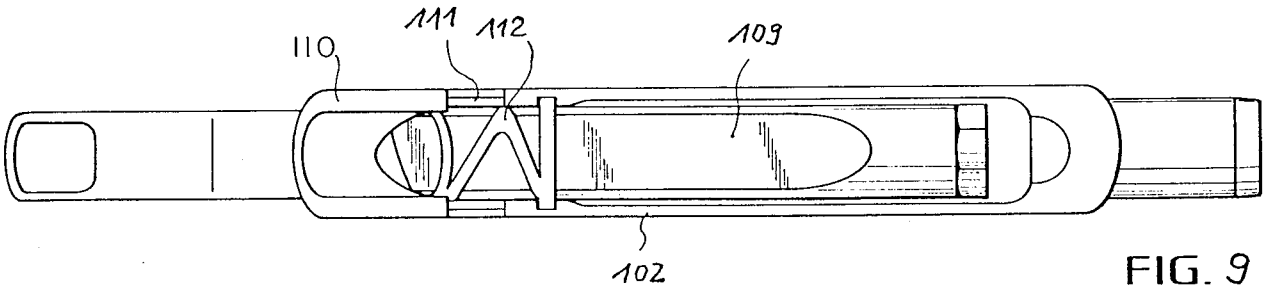
FIG. 9 is a view of the vacuum cleaner handle as in FIG. 8 from below.

The vacuum cleaner handle member 98 to be seen in FIGS. 8 and 9 has as its main component a holding part 99, whose rear member forms the handle part 100 in the strict sense, a connecting tube 101, which is joined to a handle part (not shown) of the vacuum cleaner, and a receptacle 102 for a crevice nozzle, which is positioned under the holding part. The handle part 100 makes an angle of 60° with the tube axis 103, and the upper section of the handle part projects out further than the lower part in the direction of the connecting part 101. The handle part 100 is so placed that about half is above and half is under the tube axis 103.

The holding part 99 has an upper bar member 104 extending generally parallel to the tube axis 103 which may be used as a handle part as well, a front bar member 105 extending at an angle of about 120° to the tube axis 103 in a forward direction, a first lower bar member 106 running back generally parallel to the tube axis 103, a downwardly running bar member 107 generally parallel to the handle bar member 100 and a second lower bar member 108 running back towards the lower end of the handle bar member 100. This particular polygonal configuration is very comfortable for the user to hold in his hand, the force of the hand being applied to the handle bar member 100 generally along the tube axis 103.

The trough-like receptacle 102 for a crevice nozzle 109 is so placed under the holding part 99 that its lower edge is flush with the lower edge of the lower bar member 108. A slidable flange component 110 is arranged in the lateral edges of the receptacle 102 to slide, in grooves 111 formed therein, between a hold position and a release position by V-shaped spring 112 for the inserted crevice nozzle 109.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. A vacuum cleaner handle, said handle comprising:

a handle tube having a straight end portion; and a handle member, said handle member including:

a connection part connected to said straight end portion of said handle tube;

a handle section having a first and a second end, said first end being connected to said connection member, said handle section extending substantially parallel along most of its length relative to said straight end portion of said handle tube and extending from said connection part; and a holding part, said holding part including:

a handle bar member having a first end and a second end, said first end of said handle bar member being connected at said second end of said handle section, said handle bar member extending in a direction somewhat back towards said connection part at an acute angle with respect to said straight end portion of said handle tube; and a connection member extending between and connecting said second end of said handle bar member and said connection part forming a one piece closed loop handle;

wherein at least a portion of said connection member extends at an angle relative to said handle bar member, whereby said handle member can be gripped at different angles relative to said handle tube by either said handle bar member of said connection member to facilitate manipulation of the handle.

2. The handle according to claim 1, wherein said connection part is a tubular plug inserted within said handle tube.

3. The handle according to claim 1, wherein said handle bar member and said connection member are located substantially above a central axis of said straight end portion of said handle tube.

4. The handle according to claim 1, and further including a length of electrical utility cord and a cord holder provided with said handle member.

5. The handle according to claim 4, wherein said cord holder is defined by said handle section and a pair of flange parts extending beyond the ends of said handle section, whereby said cord can be wrapped around said handle section for changing the length of said cord extending from the handle member.

6. The handle according to claim 5, wherein one of said flange parts is slidably disposed within a linear guide in said handle section for accomodating different lengths of said cord around said cord holder.

7. The handle according to claim 6, wherein said slidable flange part cooperates with a V-shaped spring connected at one end to said slidable flange part and biased at an opposite end against one end of said linear guide, said handle section being provided with an opening exposing a portion of said slidable flange part with a bar positioned at an end of said handle section and traversing said opening, further wherein said slidable flange part is provided with two protrusions defining two detent hooks each positioned at a different location along said the length of said slidable flange part for engaging with said bar for allowing said slidable flange part to be positioned at two different positions so that said cord holder can accomodate different lengths of said cord.

8. The handle according to claim 4, including a cord clamping means provided in a handle opening of the handle member for preventing the unwrapping of a length of cord wrapped around said cord holder.

9. The handle according to claim 4, wherein said handle section is provided with a receiving opening for accomodating a vacuum cleaner accessory.

10. The handle according to claim 9, wherein said accessory is a crevice nozzle.

11. The handle according to claim 10, wherein said handle section comprises a plate part extending along the bottom of said handle section and connected to a back wall plate positioned at one side of the handle member, said back wall plate being connected to a wall positioned adjacent a handle opening in the handle member, wherein said plate part, said back wall plate and said wall define said receiving opening.

12. The handle according to claim 1, wherein said handle section is provided with a receiving opening for accomodating a vacuum cleaner accessory.

13. The handle according to claim 12, wherein said accessory is a crevice nozzle.

14. The handle according to claim 13, wherein said handle section comprises a plate part extending along the bottom of said handle section and connected to a back wall plate positioned at one side of the handle member, said back wall plate being connected to a wall positioned adjacent a handle opening in the handle member, wherein said plate part, said back wall plate and said wall define said receiving opening.

15. The handle according to claim 14, wherein said back wall plate is provided with a U-shaped recess which extends across the width of said wall for facilitating removal of said crevice nozzle from said receiving opening in said handle section.

16. The handle according to claim 1, wherein said handle section comprises:

a first lower bar member extending substantially parallel with said straight end portion of said handle tube and extending from said connection part, a downwardly running bar member extending from said first lower bar member in a direction substantially parallel to said handle bar member, and a second lower bar member extending from said downwardly running bar member in a direction substantially parallel to said straight end portion of said handle tube and connected to said handle bar member.

17. The handle according to claim 16, wherein said connection part is a tubular plug inserted within said handle tube.

18. The handle according to claim 16, wherein said handle bar member is approximately equally divided by a central axis of said straight end portion of said handle tube, and said connection member is completely located above said central axis.

19. The handle according to claim 18, wherein said connection member comprises an upper bar member extending from said handle bar member in a direction substantially parallel to said central axis and a front bar member extending from said upper bar member connecting said connection member at an obtuse angle relative to said straight end portion of said handle tube.

20. The handle according to claim 19, including a trough-like receptacle, for storing a crevice nozzle, extending along the bottom of both said connection member and said handle section, said receptacle being provided with a flange part at either end for providing a cord holder.

21. The handle according to claim 20, including a slidable spring biased flange component cooperating with said receptacle for releasably latching the crevice nozzle in said receptacle.

22. The handle according to claim 21, wherein said spring biased component includes a V-shaped spring connected at an end to said receptacle.

23. The handle according to claim 19, wherein said obtuse angle is approximately 120°.

24. The handle according to claim 1, wherein said acute angle is approximately 60°.

* * * * *